US009943891B2

(12) United States Patent
Dixon

(10) Patent No.: US 9,943,891 B2
(45) Date of Patent: Apr. 17, 2018

(54) SYSTEM FOR FACILITATING THE REMOVAL OF UNWANTED COATINGS FROM PAINTED HANGERS

(71) Applicant: Production Plus Corp., Columbus, OH (US)

(72) Inventor: Donovan Dixon, South Bloomfield, OH (US)

(73) Assignee: Production Plus Corp., Ashville, OH (US)

( * ) Notice: Subject to any disclaimer, the term of this patent is extended or adjusted under 35 U.S.C. 154(b) by 55 days.

(21) Appl. No.: 14/930,996

(22) Filed: Nov. 3, 2015

(65) Prior Publication Data

US 2017/0120313 A1 May 4, 2017

(51) Int. Cl.

| | |
|---|---|
| ***B08B 11/02*** | (2006.01) |
| ***B44D 3/16*** | (2006.01) |
| *B08B 7/00* | (2006.01) |

(52) U.S. Cl.

CPC ..... *B08B 11/02* (2013.01); *B44D 3/16* (2013.01); *B08B 7/0071* (2013.01)

(58) Field of Classification Search

CPC ..... C25D 17/08; C25D 17/06; B05B 5/082; B05B 13/00; B05B 13/0285; B05B 13/0292; B05B 13/02; B08B 11/02; B08B 7/0071; B44D 3/16

USPC ..... 211/41.1, 41.14, 41.15; 118/500; 204/297.06, 297.07, 297.09, 297.1

See application file for complete search history.

(56) References Cited

U.S. PATENT DOCUMENTS

| | | | | | |
|---|---|---|---|---|---|
| 2,514,923 | A * | 7/1950 | Batina | C25D 17/08 | 204/222 |
| 3,029,952 | A * | 4/1962 | Bagdon | B65G 17/20 | 211/117 |
| 3,118,545 | A * | 1/1964 | Rosner | C25D 17/08 | 204/297.09 |
| 3,715,097 | A * | 2/1973 | Kalajian | A47B 97/04 | 248/449 |
| 3,799,488 | A * | 3/1974 | Sena | A47B 97/08 | 248/126 |
| 4,097,359 | A * | 6/1978 | Davitz | C25D 17/08 | 118/500 |
| 4,872,963 | A * | 10/1989 | Van Horn | C25D 17/08 | 118/500 |
| 5,020,677 | A * | 6/1991 | Wirth | A47F 5/08 | 118/500 |
| 5,607,069 | A * | 3/1997 | Stroobants | B05B 5/082 | 118/500 |
| 6,189,709 | B1 * | 2/2001 | Cullen | B05B 5/082 | 211/118 |
| 7,878,338 | B2 * | 2/2011 | Maxson | E04G 5/00 | 211/41.15 |
| 2003/0209504 | A1 * | 11/2003 | Cook | B62D 65/18 | 211/13.1 |

* cited by examiner

*Primary Examiner* — Patrick D Hawn

(74) *Attorney, Agent, or Firm* — Standley Law Group LLP; Melissa Rogers McCurdy; Adam Smith

(57) ABSTRACT

The present invention is a rack system for transporting and retaining powder coat hangers during a cleaning process to remove built-up coating materials from the powder coating process.

14 Claims, 3 Drawing Sheets

SYSTEM FOR FACILITATING THE REMOVAL OF UNWANTED COATINGS FROM PAINTED HANGERS

CROSS-REFERENCE TO RELATED APPLICATION

This application is a non-provisional patent application and makes no priority claim.

TECHNICAL FIELD

Exemplary embodiments of the present invention relate generally to a system and method for removing built-up coatings from a hanger used to suspend articles to be powder coated.

BACKGROUND AND SUMMARY OF THE INVENTION

Powder coating is a widely known method of applying coatings to components during a manufacturing process. In the powder coating process, parts to be coated are suspended on a rack or other hanging system. Frequently the hanging system is a cable or chain conveyor system that moved the parts through the various stages of the coating process. Workers or automated systems place the parts to be coated onto rack or hanging system using hooks. These hooks are generally sized such that the part hangs below the conveyer an amount sufficient to prevent coatings from adhering to the conveyor itself. Once the parts are positioned on the conveyor system those parts are subjected to a static charge such that the parts become charged. A powdered coating material is then introduced to the part. Often this is performed by blowing the coating across the part. The charge produced on the part causes a certain amount of powdered coating material to become attracted to and stick to the part. The powder that doesn't stick to the part may be recycled for later use. The parts, now coated with a uniform layer of coating material are moved into an oven where heat is applied to melt the powdered coating material. This heat causes the material to melt and form a permanent coating on the part to be coated. The powder coating process has many advantages over a spray or dip coating application and as a result, the powder coating process continues to grow in popularity.

In addition to powder coating processes, hangers may also be used in "wet" coating processes—that is, coating methods that use solvents to suspend the coating materials during the application process. Common wet coating methods include spraying and dipping. As with powder coating, these methods may use hangers to suspend work pieces during the application of a coating material.

In many coating processes the coating material is unavoidably applied to the hanger that is used to hang the part to be coated on the conveyer or other system used to transport the coated parts. After repeated coatings, the hanger may be subject to a buildup of coating material that may make it difficult to remove the parts, negatively impact the part coating quality or may cause the hanger to become unusable. Known methods of removing this built-up coating from parts hangers include placing the hangers in an oven and heating them to a point at which the bond between the coating and the hanger fails and the coating can be easily removed (generally referred to as a "burn-off" process). Currently, this burn-off process is generally performed in a dedicated cleaning oven. Such an oven may not be economically feasible for an organization which performs a limited amount of coating. As a result, hangers must be gathered from the coating process and moved to the cleaning oven location. In addition, the hangers must be arranged such that they are evenly heated. Ideally such an arrangement allows for a uniform distribution of the hangers in the cleaning oven.

What is needed is a system and method for storage, transportation and cleaning of coated hangers. In an embodiment of the invention, a rack structure may be formed that permits coated hangers to be hung from the rack after use and transported to the location of the cleaning oven for coating. In such an embodiment, each rack structure may comprise a series of primarily horizontal rails upon which the coated hangers may be suspended. In embodiments of the invention, a second horizontal rail may be positioned such that it is parallel with the first rail and is arranged such that it may be positioned to form a space between the first and second rails sufficient to permit hangers to be hung from the first rail. In such an embodiment, the second horizontal rail may be repositioned such that it moves closer to the first rail and as a result, captures the hangers between the two rails. This capture may permit the rack structure to be moved to location of the cleaning oven with the hangers in place without the hangers falling off of the structure. Embodiments of the invention may comprise a plurality of such rails. Certain embodiments of the invention may also be configured to allow multiple racks to be positioned together for shipment from a first location to a cleaning location in order to provide a more stable and compact structure.

Further features and advantages of the devices and systems disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Figure 1:
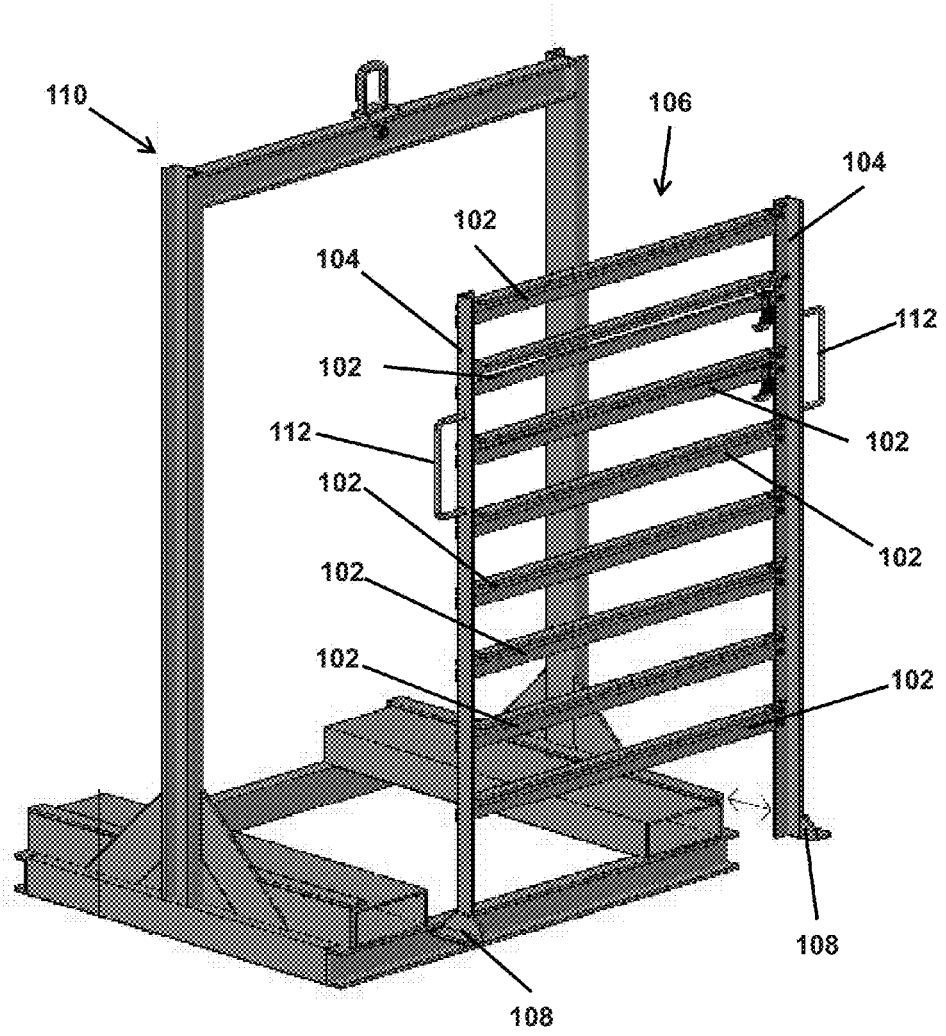
FIG. 1 is a perspective view of an embodiment of the invention illustrating a rack and a rack transporting device.

Referring to FIG. 1, an example embodiment is shown with a plurality of horizontal hanging rails 102. As is illustrated, these rails may be located between a pair of vertical rails 104 to form a cleaning rack structure 106. In addition to the horizontal 102 and vertical rails 104, embodiments of the invention may also comprise a base structure 108. In certain embodiments of the invention, the base structure 108 illustrated in FIG. 1 is intended for insertion into a rack transportation frame 110. Other embodiments of the cleaning rack 106 may also be configured with a base structure that will support the cleaning rack in an upright position without the need for a transportation frame. Embodiments of the invention may also comprise handling devices such as handles 112 to facilitate easy handling of the racks as they are inserted and removed from the transportation frame.

Figure 2:
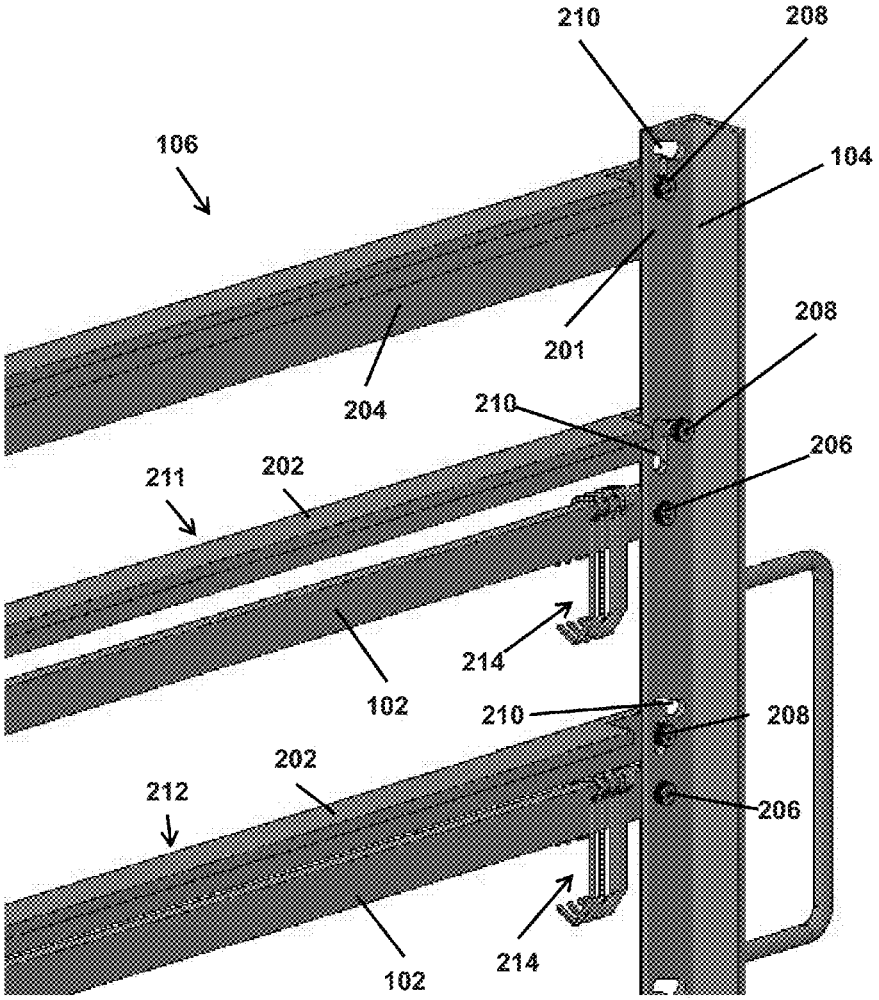
FIG. 2 is a view of a first and second horizontal rail in an embodiment of the invention.

As is illustrated in FIG. 2, the horizontal hanging rails 102 may be secured without fasteners through the use of welding or a similar process as illustrated at 201. This may be particularly beneficial for the upper most and lowest rails of a cleaning rack 106 to permit the formation of a more rigid cleaning rack structure. As is shown, a horizontal hanging rail 102 may also be secured to a vertical rail 104 by the use of a fastener 206. Such a fastener may include, but is not limited to, screws, nuts and bolts, or rivets. The use of a removable fastener such as a nut and bolt may permit the horizontal rails to be repositioned or removed as needed to accommodate larger hangers. For example, should a situation arise wherein the hangers are sufficiently long as to impact the hanging rail below the rail upon which the hangers are hung, interfering hanging rail and upper rail may be removed to permit the longer hangers to be suspended from a hanging rail 102 unimpeded.

As shown in FIG. 2, an upper rail 202 may be positioned above the handing rail 102. This upper rail may be positioned such that it may be moved to a second position in order to secure hangers suspended from the hanging rail. This is illustrated at 212. As is shown in FIG. 2, a slot 210 may be formed in a horizontal rail such that the upper rail 202 may be moved from a first position shown at 211 to a second position illustrated at 212. In certain embodiments of the invention, such a slot 210 may comprise a vertical portion and a horizontal portion such that the upper rail may be lifted up held in such a position by a fastener 208 that is moved into a horizontal portion of the slot 210, resulting in the upper rail being suspended above the hanging rail 102. In other embodiments, the slot 210 may comprise only a vertical portion and use a fastener 208 that may be tightened in order to hold the upper rail 202 away from the hanging rail 102 while hangers are positioned on the hanging rail for cleaning. As is illustrated at 212, when upper rail 202 is lowered, it may trap a plurality of hangers 214 against the hanging rail 102, thereby preventing the hangers from falling from the hanging rail during transportation. In certain embodiments of the invention, the fastener 208 may be tightened to further secure the hangers 214 between the rails.

Figure 3:
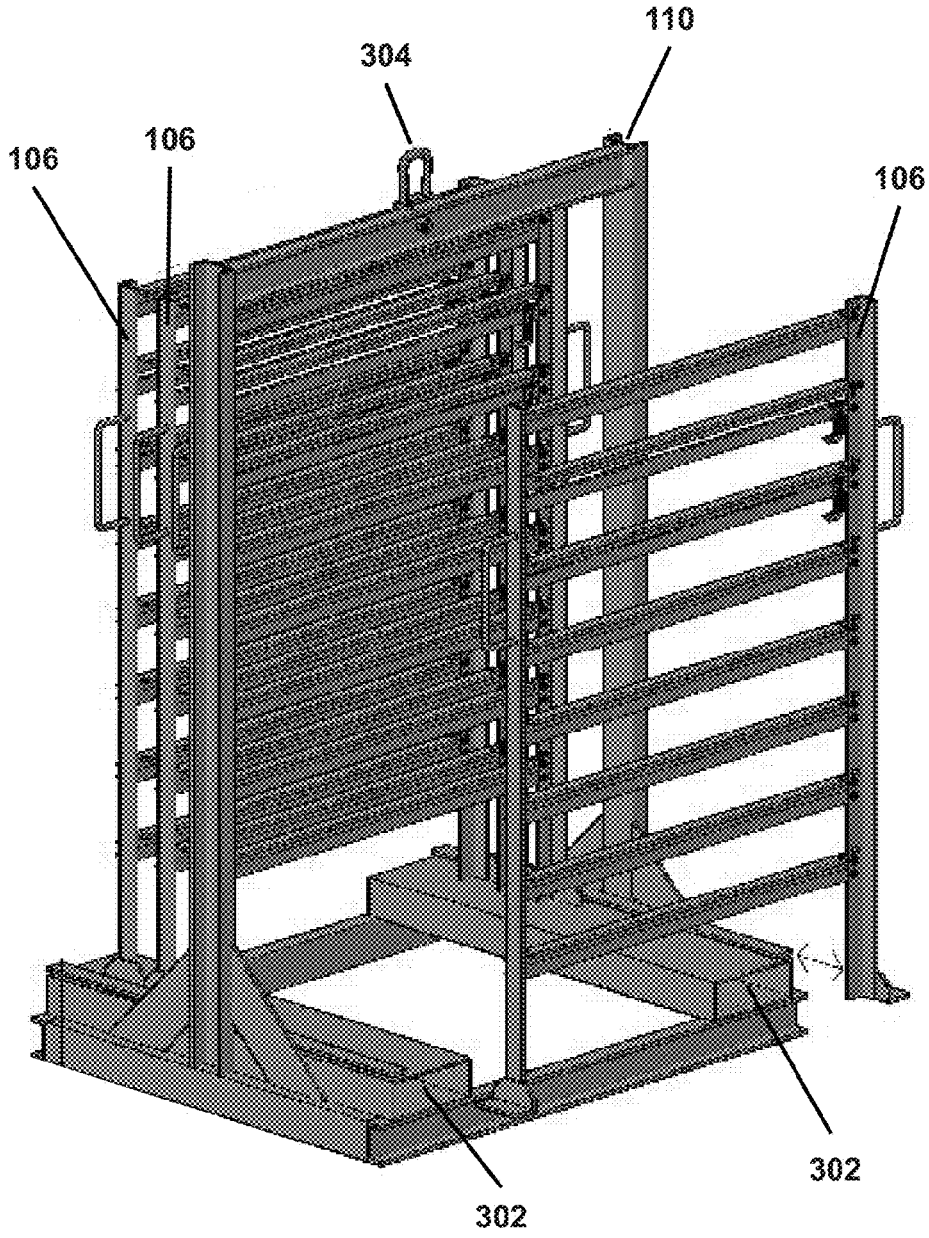
FIG. 3 is a perspective view of an embodiment of the invention illustrating the positioning of multiple racks positioned in a rack transporting device.

Referring again to FIG. 1, in order to facilitate efficient transportation of cleaning racks 106 to a burn-off location, a plurality of cleaning racks may be positioned in a rack transportation frame 110. As is shown at 108, in certain embodiments of the invention, cleaning racks 106 may be equipped with a foot structure 108 that may be inserted into a rail or other interface for receiving such a foot on the rack transportation frame 110. As is shown in FIG. 3, a plurality of cleaning racks 106 may be inserted into a rack transportation frame 110 prior to transportation of the cleaning racks to a burn-off facility. As is shown in the embodiment illustrated in FIG. 3, the transportation frame 110 may comprise features that allow the frame to be easily transported or maneuvered. Examples include lifting eyes 304 and forklift channels 302. Other embodiments may also comprise wheels or skids to enable the easy movement of the transportation frame when loaded with cleaning racks 106.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A rack for securing and transporting a plurality of hangers for cleaning, said hangers configured to suspend parts for powder coating, the rack comprising:

a plurality of vertical rails;

a plurality of first substantially horizontal rails affixed to said vertical rails and configured to permit the suspension of said plurality of hangers therefrom;

a base structure located at the lower end of each of said vertical rails; and a plurality of second substantially horizontal rails moveably attached to said vertical rails such that each of the second substantially horizontal rails may be placed in contact with an upper surface of a corresponding first substantially horizontal rail such that said suspended plurality of hangers are trapped between the first and second substantially horizontal rails when said second substantially horizontal rail is allowed to come in contact with said hangers;

wherein said second plurality of substantially horizontal rails are guided by channels formed in said vertical rails where said channels comprise a substantially vertical opening formed with a second, substantially horizontal opening that allows the second plurality of substantially horizontal rails to move vertically relative to the corresponding first substantially horizontal rail and be held at a location apart from the corresponding first substantially horizontal rail.

2. The rack of claim 1, where the uppermost first substantially horizontal rail is welded to said vertical rails and where the lowermost first substantially horizontal rail is welded to said vertical rails.

3. The rack of claim 1, wherein said second plurality of substantially horizontal rails are guided by channels formed in said vertical rails where said channels are a substantially straight opening that allows the second plurality of substantially horizontal rails to move vertically relative to the corresponding first substantially horizontal rail.

4. The rack of claim 3, wherein the second plurality of substantially horizontal rails are held in their respective channels by a nut and bolt arrangement that may be configured to fix the substantially horizontal rail in place by tightening said nut and bolt.

5. The rack of claim 1, wherein the second plurality of substantially horizontal rails are held in said channels by a nut and bolt arrangement that may be configured to fix the substantially horizontal rail in place by tightening said nut and bolt.

6. The rack of claim 1, wherein said second plurality of substantially horizontal rails are removably affixed to said vertical rails by a nut and bolt located adjacent to each end of the horizontal rails.

7. The rack of claim 1, wherein said second plurality of substantially horizontal rails are affixed to said vertical rails by a rivet located adjacent to each end of the horizontal rails.

8. A system for securing and transporting a plurality of hangers for cleaning, said hangers configured to suspend parts for powder coating, the system comprising:

a first rack for securing said hangers comprising:

a first and second vertical rail positioned substantially parallel to one another, a first plurality of substantially horizontal rails extending between said first and second vertical rails and configured to receive said plurality of hangers in a suspended arrangement, a first base structure located at the lower end of each of said first and second vertical rails, and a second plurality of substantially horizontal rails that are moveably attached to said first and second vertical rails such that each of the second plurality of substantially horizontal rails may be placed in contact with the corresponding substantially horizontal rail from said first plurality of substantially horizontal rails, wherein said plurality of hangers are sandwiched between the respective first and second substantially horizontal rails when the respective second substantially horizontal rail is moved into contact with said corresponding first substantially horizontal rail; and a second rack for the transportation of said first rack comprising:

a plurality of vertical members;

a horizontal member attached at its ends to a top end of said vertical members; and a second base structure comprising a first and second member oriented parallel to each other and perpendicular to said plurality of vertical members and attached to a lower end of said vertical members;

wherein said second rack is configured to accept the first rack.

9. The system of claim 8, wherein the horizontal member also comprises a means to allow the system to be lifted by the horizontal member.

10. The system of claim 9, wherein the means is at least one lifting eye affixed to the horizontal member.

11. The system of claim 8, wherein the base structure comprises a plurality of openings which are configured to accept the forks of lift truck.

12. The system of claim 8, further comprising a support bracket structure connecting each of the vertical members to the first base structure.

13. The system of claim 8 wherein the second plurality of substantially horizontal rails are guided by channels formed in the first and second vertical rails where said channels comprise a substantially vertical opening formed with a second, substantially horizontal opening that allows the second plurality of substantially horizontal rails to move vertically relative to the corresponding first substantially horizontal rail and be held at a location apart from the corresponding first substantially horizontal rail.

14. A system for securing and transporting a plurality of hangers for cleaning, said hangers configured to suspend parts for powder coating, the system comprising:

a plurality of hanging racks each rack comprising:

a plurality of vertical rails;

a plurality of first substantially horizontal rails affixed to said vertical rails;

a base structure located at the lower end of each of said vertical rails; and a plurality of second substantially horizontal rails moveably attached to said vertical rails such that the second substantially horizontal rails may be placed in contact with an upper surface of a corresponding first substantially horizontal rail such that the hangers are suspended on one of the first substantially horizontal rails and are trapped between the first and second substantially horizontal rails when said second substantially horizontal rail is allowed to come in contact with said hangers and where said plurality of second substantially horizontal rails are guided by channels formed in said vertical rails where said channels comprise a substantially vertical opening formed with a second, substantially horizontal opening that allows the second substantially horizontal rails to move vertically relative to the corresponding first substantially horizontal rail and be held at a location apart from the corresponding first substantially horizontal rail, where the second substantially horizontal rail is held in said channels by a nut and bolt arrangement that may be configured to fix the second substantially horizontal rail in place by tightening said nut and bolt; and a holder for transporting said plurality of hanging racks said holder comprising:

a plurality of vertical members;

a horizontal member attached at its ends to a top end of said vertical members; and a holder base structure comprising a first and second member oriented parallel to each other and perpendicular to said plurality of vertical members and attached to a lower end of said vertical rail members:

wherein said holder base structure is configured to accept the base structures of said hanging racks.

* * * * *